US011866076B2

(12) United States Patent
Schmidt et al.

(10) Patent No.: US 11,866,076 B2
(45) Date of Patent: Jan. 9, 2024

(54) TRACK CIRCUIT WITH CONTINUED DISTANCE MONITORING AND BROKEN RAIL PROTECTION

(71) Applicant: Siemens Mobility, Inc., New York, NY (US)

(72) Inventors: Holger Schmidt, Saint Johns, FL (US); Brian Harp, New Albany, IN (US); Brian Joseph Hogan, Temecula, CA (US); A. Nathan Edds, La Grange, KY (US)

(73) Assignee: Siemens Mobility, Inc., New York, NY (US)

( * ) Notice: Subject to any disclaimer, the term of this patent is extended or adjusted under 35 U.S.C. 154(b) by 1203 days.

(21) Appl. No.: 16/476,668

(22) PCT Filed: Jun. 2, 2017

(86) PCT No.: PCT/US2017/035618

§ 371 (c)(1),
(2) Date: Jul. 9, 2019

(87) PCT Pub. No.: WO2018/151747

PCT Pub. Date: Aug. 23, 2018

(65) Prior Publication Data

US 2021/0139059 A1 May 13, 2021

Related U.S. Application Data

(60) Provisional application No. 62/459,780, filed on Feb. 16, 2017.

(51) Int. Cl.
*B61L 1/18* (2006.01)
*B61L 23/04* (2006.01)

(52) U.S. Cl.
CPC ..... *B61L 1/187* (2013.01); *B61L 1/185* (2013.01); *B61L 1/188* (2013.01); *B61L 23/044* (2013.01)

(58) Field of Classification Search
CPC ..... B61L 1/18–20; B61L 23/044
See application file for complete search history.

(56) References Cited

U.S. PATENT DOCUMENTS

| | | | | |
|---|---|---|---|---|
| 4,306,694 | A | 12/1981 | Kuhn | |
| 8,746,628 | B2 * | 6/2014 | Zhang | B61L 1/181 455/78 |
| 2008/0142645 | A1 * | 6/2008 | Tomlinson | B61L 1/181 246/122 R |
| 2013/0334373 | A1 | 12/2013 | Malone et al. | |
| 2016/0257320 | A1 * | 9/2016 | Harp | B61L 27/57 |

FOREIGN PATENT DOCUMENTS

WO 2008076533 A1 6/2008

OTHER PUBLICATIONS

PCT International Search Report and Written Opinion of International Searching Authority dated Nov. 9, 2017 corresponding to PCT International Application No. PCT/US2017/035618 filed Jun. 2, 2017.

* cited by examiner

*Primary Examiner* — Zachary L Kuhfuss

(57) ABSTRACT

Aspects of the disclosed embodiments generally relate to railway track circuits, in particular track circuits with continued distance monitoring and broken rail protection.

13 Claims, 3 Drawing Sheets

TRACK CIRCUIT WITH CONTINUED DISTANCE MONITORING AND BROKEN RAIL PROTECTION

CROSS REFERENCE TO RELATED APPLICATION

This application claims priority to U.S. Provisional Application Ser. No. 62/459,780, filed Feb. 16, 2017, the entirety of which is incorporated herein by reference.

BACKGROUND

1. Field

Aspects of the disclosed embodiments generally relate to railway track circuits, in particular track circuits with continued distance monitoring and broken rail protection.

2. Description of the Related Art

Track circuits may be used in the railroad industry to detect the presence of a train in a block of track. Track circuit hardware may include transmitters and receivers configured to work with coded alternating current (AC), coded direct current (DC), or audio frequency (AF) signals. Different track circuits may function in different ways to detect trains and may therefore have different hardware requirements. For example, some track circuits (such as AC overlay circuits) may have a transmitter configured to transmit a signal through the track rails at one end of a block of track and a receiver connected to the rails at the other end of the block and configured to detect the signal. Other than the connection through the track rails, there may typically be no connection between the transmitter and receiver for a block. When a train is present in a block of track monitored by a track circuit, the train may shunt, or short, the two rails, with the result that no signal is received at the receiver. Thus, the receiver may use the presence or absence of a detected signal to indicate whether or not a train is present in the block.

In some other track circuits, sometimes referred to as constant warning time circuits, a transmitter may transmit a signal over a circuit formed by the rails of the track and one or more shunts positioned at desired approach distances from the transmitter. A receiver may detect one or more resulting signal characteristics, and a logic circuit such as a microprocessor or hardwired logic may detect the presence of a train and may determine its speed and distance from a location of interest such as a crossing. The track circuit may detect a train and determine its distance and speed by measuring impedance changes due to the train's wheels and axle acting as a shunt across the rails and thereby effectively shortening the length (and hence the impedance) of the rails in the circuit.

SUMMARY

Embodiments disclosed herein provide a track circuit for a railroad track block. In one example embodiment the track circuit comprises a first occupied track device connected to rails of the railroad track block at a first portion of the block; and a second occupied track device connected to the rails of the railroad track block at a second portion of the block. The first and second occupied track devices being configured to detect a presence of a train on the rails of the block using a DC function, and once the presence of the train is detected, determine an amount of unoccupied track behind the train using an AC function.

In another embodiment, a method of monitoring a railroad track block is provided. The method comprises performing a DC function to detect a presence of a train on rails of the block and, once the presence of the train is detected, performing an AC function to determine an amount of unoccupied track behind the train.

In one or more embodiments, the track circuit and method disclosed herein may also determine if a rail within the block is broken while the train is within the block.

Further areas of applicability of the present disclosure will become apparent from the detailed description, drawings and claims provided hereinafter. It should be understood that the detailed description, including disclosed embodiments and drawings, are merely exemplary in nature intended for purposes of illustration only and are not intended to limit the scope of the invention, its application or use. Thus, variations that do not depart from the gist of the invention are intended to be within the scope of the invention.

DETAILED DESCRIPTION

Figure 1:
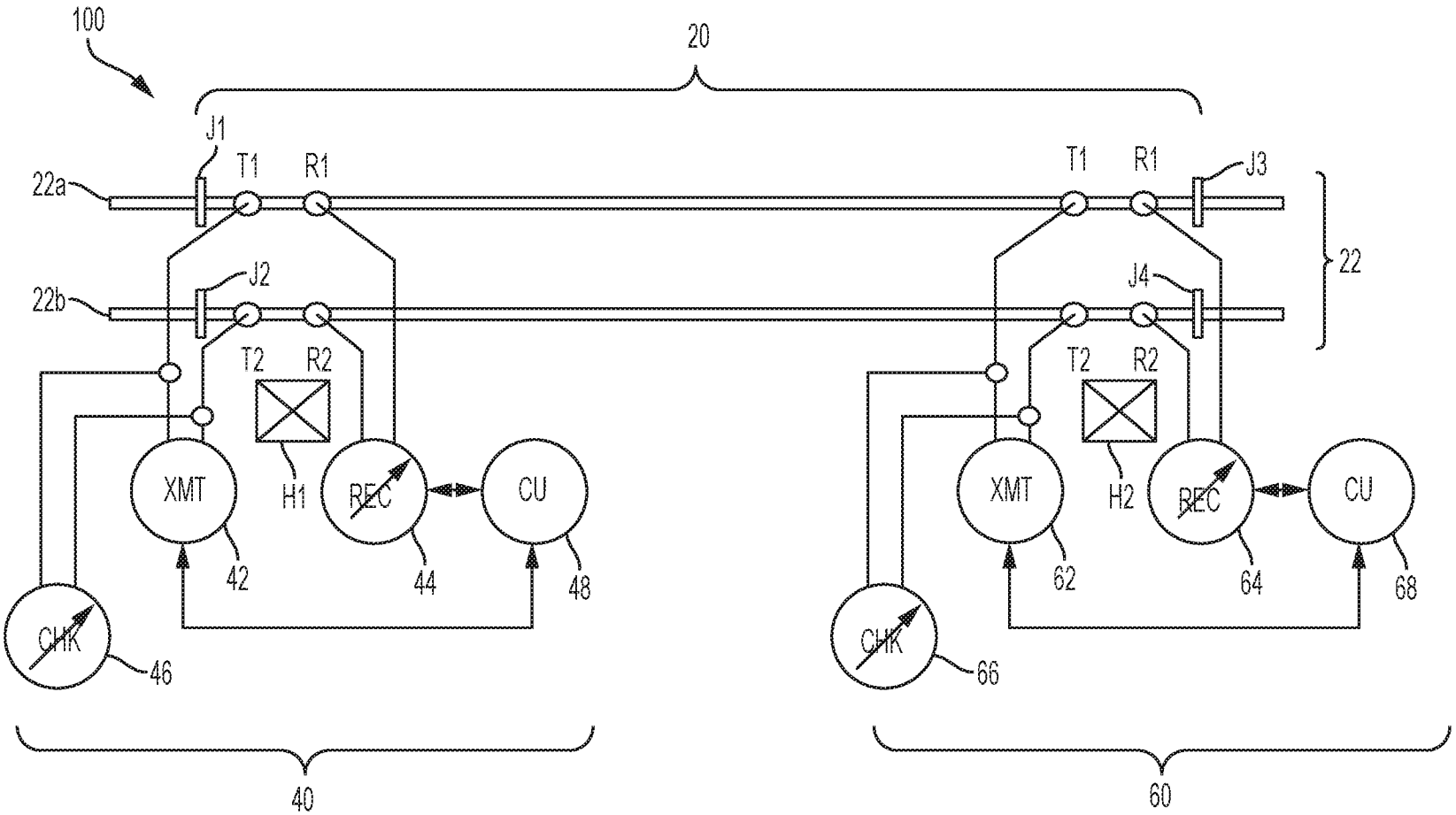
FIG. 1 illustrates an example track circuit in accordance with an embodiment disclosed herein.

The components and materials described hereinafter as making up the various embodiments are intended to be illustrative and not restrictive. Many suitable components and materials that would perform the same or a similar function as the materials described herein are intended to be embraced within the scope of embodiments of the present invention.

When occupied, currently existing wayside track circuits deliver a single bit of information to a signal system: track occupied (if the track is vacant, there is more information available, see for example coded DC track circuits). The information presented to the rest of the signal system in a wayside track circuit is the same regardless of the position of the train within the signal block, whether it has insulated rail joints for definition or not. A train that is one foot inside of a signal block gives the same information to the signal system as a train that is 7000 feet into the block. This means that the signal system has no finer resolution of the train's position other than the length of the signal blocks themselves. The signal system must protect trains by ensuring that e.g., they are properly spaced and at a speed to maintain the spacing. Since the resolution of this positioning must be the length of the block (in most cases two or more blocks to ensure spacing and to keep the trains moving without slowing them down), the signal system must protect the trains as if the signal blocks are immediately occupied within their limits regardless of where the train actually is within that block. This results in inefficient protection as the actual distance between trains is not being used in the determination.

"Moving block" systems and "virtual block" systems have been developed to provide more information on train position within a block, but they require the use of external systems such as a Positive Train Control Onboard Unit (PTC OBU) or GPS for locomotive position or an End of Train (EOT) device to provide train integrity and rear of train information. Thus, the following information is available to the signal system using one or more of these systems:

Physical block (track circuit) occupancy,

Position of the locomotive (e.g., positive train control (PTC OBU), GPS), and

Train integrity (e.g., end of train devices—EOT).

All of these external systems, however, require additional equipment and also restrict the moving block and virtual block systems to use with trains that have this additional equipment. Thus, these systems are not interoperable because they depend on the equipment of the trains to work properly. It is therefore desirable to have a system that detects the end of a train without requiring trains to be equipped with special equipment, making the system more interoperable than prior techniques because the system will not be dependent upon the train's equipment and can therefore be used with almost any train suitable for the track.

Moreover, there is no information available regarding how far the end of the train has already passed the initial set of joints of the block and there is also no information available as to whether the rail is still intact behind the train (i.e., broken rail protection) until the end of this train passes the next set of insulated joints. Thus, there is a need and desire to add the following information to an occupied track circuit while also re-using existing track infrastructure (e.g., insulated joints, cables, etc.):

information regarding how far or how much (e.g., 0%, 25%, 50%, 75%, 100%) of a track circuit/block is unoccupied behind the last car (last axle) of a train with an accuracy of +/−10% or about ¼ of a mile, and information regarding rail integrity (broken rail protection) for the unoccupied portion of the track (e.g., behind the train).

In accordance with an exemplary embodiment of the disclosed principles, circuitry of coded DC track circuits (e.g., available such as in GEO track card, Waytrax, CTM2) and circuitry of an AC track circuit of a constant warning time device, also known as a grade crossing predictor (e.g., available as GCP4000/5000 provided by Siemens), are combined to form an occupied track device. In other words, a "DC function" and an "AC function" of different track circuits are combined to form an occupied track device constructed in accordance with the disclosed principles. In an example implementation, a solution of such a combination may comprise a daughter board, or an extra card that occupies a neighboring slot in a grade crossing predictor. An example of variable frequency train detection and a constant warning time device are described for example in US Patent Application Publication No. 2014/0319285 to Hogan, which is incorporated herein in its entirety.

In exemplary embodiments, low AC frequencies, adjustable at both ends of a track circuit, are used to reach long distances and to avoid common crossing frequencies. Low AC frequencies may be for example 44 Hz, 45 Hz, and 46 Hz. The AC frequency needs to be adjustable at both ends of the track circuit to prevent possible interference (light engine/single train car/bad shunting conditions). If necessary, coding/addressing are added to minimize crosstalk and interference. Coding can comprise very low baud rate transmissions and can be done using for example frequency-shift keying (FSK).

In an example implementation, the AC function remains inactive while the DC function indicates an unoccupied block. Upon occupancy detection by the DC function, the AC function activates and determines the amount of unoccupied rail, which will be close to zero as the train goes by. Evaluation of the AC function starts after it is detected that 1) a train occupied the track and 2) the occupancy happens at the near joint. An interface to a CPU of a control system can be realized serially over a backplane bus.

Figure 2:
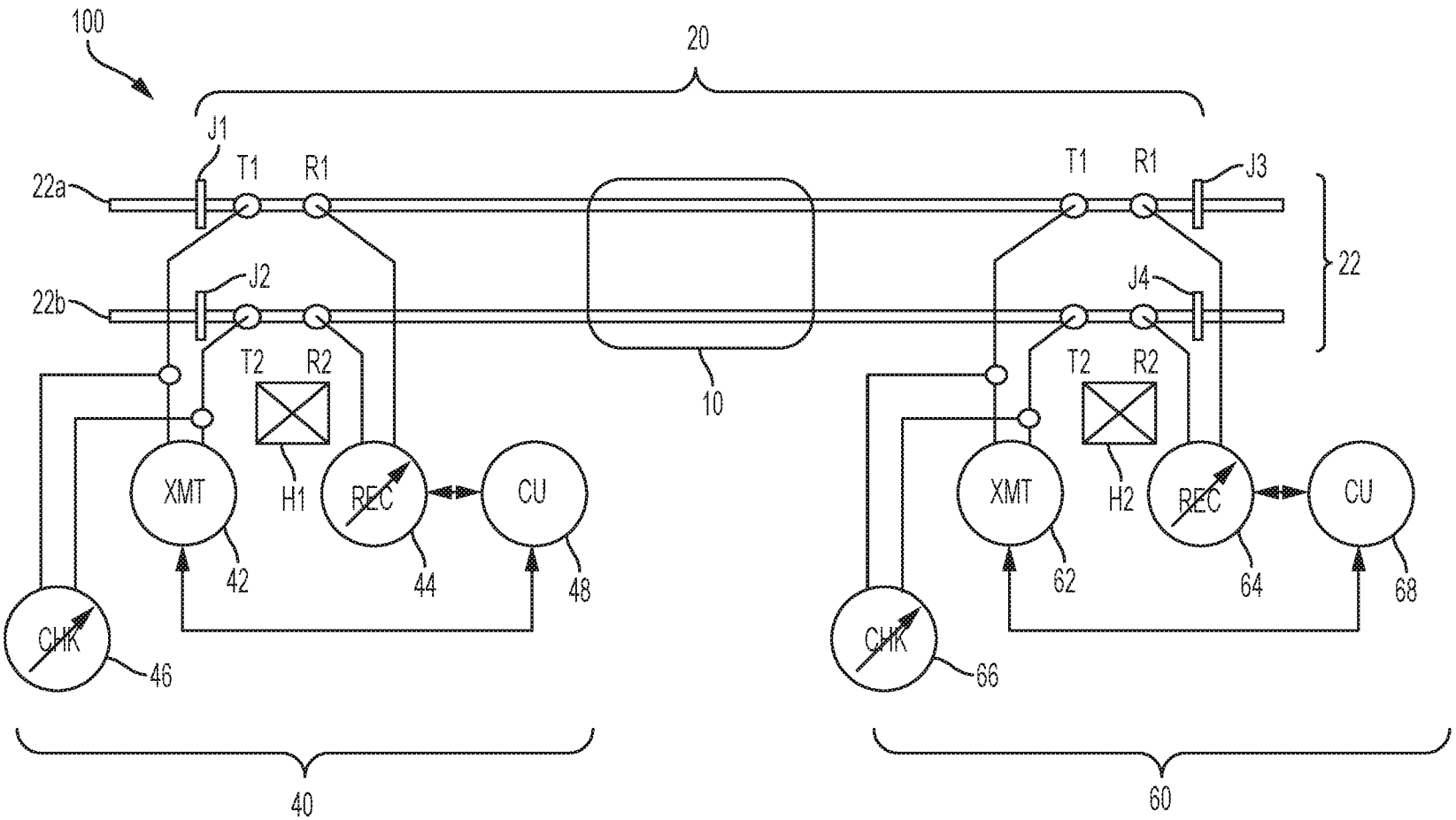
FIG. 2 illustrates the example track circuit illustrated in FIG. 1 being occupied by a train.

FIG. 1 illustrates an example track circuit 100 in accordance with an embodiment disclosed herein. FIG. 2 illustrates the example track circuit 100 being occupied by a train 10. The track circuit 100 is at a block 20 comprising a portion of a railroad track 22. The block 20 may be defined for example by insulated joints J1, J2, J3, J4 or by any other known technique. The railroad track 22 includes two rails 22*a*, 22*b* and a plurality of ties (not shown in FIG. 1) that are provided over and within railroad ballast (not shown in FIG. 1) to support the rails. The train 10 is illustrated as being in the middle of the block 20 for example purposes only. In accordance with the disclosed principles, track occupied devices 40, 60 will detect a presence of the train 10 within the block 20 using a DC function and then use an AC function to determine the distances to the front and rear of the train 10 and therefore how much of the block 20 is unoccupied in the front and rear of the train 10. Rail integrity can also be determined by the circuit 100 in a simple and efficient manner as is discussed below in more detail.

The track circuit 100 includes a first occupied track device 40 constructed in accordance with the disclosed principles that comprises a transmitter 42 connected across the rails 22*a*, 22*b* at points T1, T2 and a receiver 44 connected across the rails 22*a*, 22*b* at points R1, R2. A check receiver 46 is connected across the connections of the transmitter 42. The check receiver 46 is used to detect faults between the transmitter 42 and the rails 22*a*, 22*b*. The transmitter 42, receiver 44 and check receiver 46 are shown outside of an equipment housing H1, but those of skill in the art will recognize that the components of the transmitter 42, receiver 44 and check receiver 46, other than the physical conductors that connect to the track 22, are often co-located within the housing H1.

The transmitter 42, receiver 44 and check receiver 46 of the first device 40 are also connected to a control unit 48, which is also often located in the aforementioned housing H1 (the connection between the control unit 48 and the check receiver 46 is not shown to prevent cluttering of the figure). The control unit 48 may also be connected to and include logic for controlling warning devices (e.g., crossing gates). The control unit 48 also includes logic (which may be implemented in hardware, software, or a combination thereof) for performing the various functions described herein, discussed in more detail below with respect to FIG. 3, as well as constant warning time functions if desired.

The track circuit 100 also includes a second occupied track device 60 constructed in accordance with the disclosed principles that comprises a transmitter 62 connected across the rails 22*a*, 22*b* at points T1, T2 and a receiver 64 connected across the rails 22*a*, 22*b* at points R1, R2. A check receiver 66 is connected across the connections of the transmitter 62. The check receiver 66 is used to detect faults between the transmitter 62 and the rails 22*a*, 22*b*. The transmitter 62, receiver 64 and check receiver 66 are shown outside of an equipment housing H2, but those of skill in the art will recognize that the components of the transmitter 62, receiver 64 and check receiver 66, other than the physical conductors that connect to the track 22, are often co-located within the housing H2.

The transmitter 62, receiver 64 and check receiver 66 of the second device 60 are also connected to a control unit 68, which is also often located in the aforementioned housing H2 (the connection between the control unit 68 and the check receiver 66 is not shown to prevent cluttering of the figure). The control unit 68 may also be connected to and include logic for controlling warning devices (e.g., crossing gates). The control unit 68 also includes logic (which may be implemented in hardware, software, or a combination thereof) for performing the various functions described herein, discussed in more detail below with respect to FIG. 3, as well as constant warning time functions if desired.

In one implementation, the first and second track occupied devices 40, 60 are calibrated so that the first track occupied device 40 knows the impedance provided by the second track device 60. In essence, the impedance of the second track occupied device 60 represents a shunt used by existing constant warning time circuits as discussed above. That is, once calibrated, the first track occupied device 40 will be able to determine a train's 10 speed and distance from the second track occupied device 60 by measuring impedance changes (due to the train's wheels and axle acting as a shunt across the rails 22*a*, 22*b*) based on the expected impedance of the second track occupied device 60.

Likewise, the second track occupied device 60 will be calibrated such that it knows the impedance provided by the first track device 40. In essence, the impedance of the first track occupied device 40 represents a shunt used by existing constant warning time circuits as discussed above. That is, once calibrated, the second track occupied device 60 will be able to determine a train's 10 speed and distance from the first track occupied device 40 by measuring impedance changes (due to the train's wheels and axle acting as a shunt across the rails 22*a*, 22*b*) based on the expected impedance of the first track occupied device 40.

If desired, gain values of the signals transmitted by the respective transmitters 42, 62 can be adjusted so that the track circuit 100 is balanced. When performing the AC function discussed below in more detail, each transmitter 42, 62 can transmit low frequency signals on the track 22. Signal characteristics of return signals detected by the respective receivers 44, 64 and check receivers 46, 66 are used to determine a distance, speed, and direction of the train 10 in a manner similar to a constant warning time device such as e.g., a gate crossing predictor. Based on the direction of the approaching train 10, one occupied track device 40, 60 will determine the distance to the front of the train 10, while the other occupied track device 40, 60 will determine the distance to the back of the train 10. Thus, the occupied track circuits 40, 60 can determine distance voltages that are used to determine where the front and back of the train 10 are. This information can be used to determine how far or how much (e.g., 0%, 25%, 50%, 75%, 100%) of the track circuit 100/block 20 is unoccupied behind the last car (last axle) of the train 10 with an accuracy of +/−10% or about ¼ of a mile. If desired, the same information can be used to determine how much of the track circuit 100 is unoccupied in front of the train.

The knowledge of each other's impedance and signal characteristics provides an additional benefit regarding rail integrity (broken rail protection) for the unoccupied portion of the track 22 (e.g., behind the train). For example, because the two occupied track circuits 40, 60 are calibrated to the impedance of the other device 40, 60, rail integrity can be determined while the train 10 is on the track 22 if one of the circuits 40, 60 receives signals inconsistent with (i.e., an abnormality) an approaching/departing train 10. For example, since the track circuit 100 is balanced, a train 10 entering the block 20 will cause shunting and more loading on the circuit 100. If there is a broken rail 22*a*, 22*b*, however, impedance will be unexpectedly removed from the block 20, meaning that there will be less loading than what the circuits 40, 60 were calibrated to (for the AC function) and the DC function will not be able to see end-to-end of the block 20. This rail integrity determination can be made as the train 10 is still within the block 20, which is not done in today's track circuits.

Each track occupied device 40, 60 will also be capable of performing a DC function in accordance with the disclosed principles. The DC function is performed to detect the presence of a train 10 on the track 22. In the DC function, coded DC pulses are transmitted by the respective transmitters 42, 62. If there are no problems with the track 22, the DC function can see from end-to-end of the block 20. Once the receivers 44, 64 receive a signal that indicates that the train 10 has entered the block 20, the track occupied devices 40, 60 will begin performing the AC function discussed above. The DC function is preferred while the track 22 is unoccupied since it uses lower power and there is little chance that it will cause interference with or otherwise disturb other equipment attached to the track 22.

Figure 3:
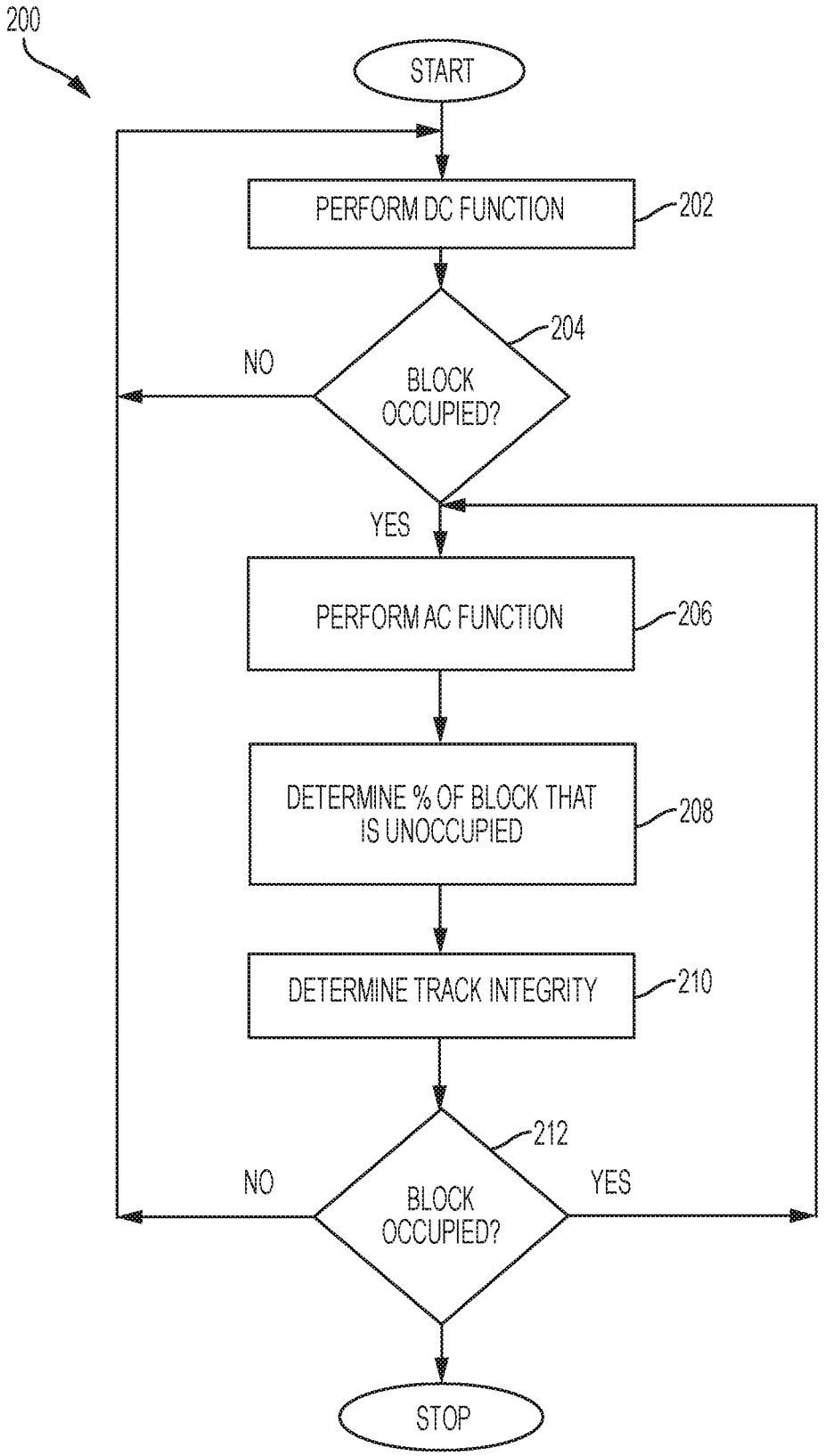
FIG. 3 illustrates an example method performed by the track circuit disclosed herein.

FIG. 3 illustrates an example method 200 performed by the occupied track devices 40, 60 in accordance with the disclosed principles. The method 200 can be implemented in software and carried out by the respective control units 48, 68 of the devices 40, 60. Program instructions for implementing the method 200 can be stored in a non-volatile memory that may be part of, or connected to, the control units 48, 68. The control units 48, 68 can be processors or other programmed controllers suitable for performing the method 200 and other necessary processing disclosed herein.

At step 202, the control units 48, 68 cause their respective track occupied devices 40, 60 to perform the DC function. During the DC function, coded DC pulses are transmitted by the respective transmitters 42, 62 along the rails 22*a*, 22*b*. At step 204, the control units 48, 68 perform a check to determine if any portion of the block 20 has become occupied. This check can be performed by analyzing any received signals that the receivers 44, 64 input from the rails 22*a*, 22*b*. If one or both of the control units 48, 68 detect that a train 10 has entered the block (i.e., the block is occupied), the method 200 continues at step 206. Otherwise, the method 200 continues at step 202.

At step 206, the control units 48, 68 cause their respective track occupied devices 40, 60 to perform the AC function. During the AC function, each transmitter 42, 62 transmits low frequency signals on the track 22. Return signals are used in step 208 to determine the percentage of the block 20 that is occupied by the approaching train 10. For example, signal characteristics of return signals detected by the respective receivers 44, 64 and check receivers 46, 66 are used to determine a distance, speed, and direction of the train 10. Based on the direction of the approaching train 10, one occupied track device 40, 60 will determine the distance to the front of the train 10, while the other occupied track device 40, 60 will determine the distance to the back of the train 10. Thus, the occupied track circuits 40, 60 can determine distance voltages that are used to determine where the front and back of the train 10 are. This information is used to determine how far or how much (e.g., 0%, 25%, 50%, 75%, 100%) of the track circuit 100/block 20 is unoccupied behind the last car (last axle) of the train 10. If desired, the same information can be used to determine how much of the track circuit 100 is unoccupied in front of the train.

At step 210, the control units 48, 68 use the existing information to determine the integrity of the track 22 based on anomalies reflected in the signal information (e.g., impedance readings that are lower than the calibrated impedance). At step 212, the control units 48, 68 perform a check to determine if the block 20 has become unoccupied. If the block 20 is still occupied, the method continues at step 206. Once the track is unoccupied, the method 200 restarts at step 202.

The disclosed track circuit 100 and method 200 can determine the actual train position to +/−10% of the block size (allowing for environment and other variables), which is a substantial improvement over the "single bit" operation of the current wayside track circuits. In addition, the disclosed track circuit 100 and method 200 provide operations equivalent to the virtual block and moving block systems without needing the trains or rail vehicles to be specially equipped with costly equipment, meaning that the disclosed track circuit 100 and method 200 can be used with almost any train or rail vehicle.

Another advantage of the disclosed track circuit 100 and method 200 is their ability to verify that the rails of the circuit 100 are intact between the train and both ends of the track circuit 100. A conventional track circuit would not be able to report a broken rail until the train had left the block and it was determined that the circuit still showed an "occupied" status.

The foregoing examples are provided merely for the purpose of explanation and are in no way to be construed as limiting. Further areas of applicability of the present disclosure will become apparent from the detailed description, drawings and claims provided hereinafter. While reference to various embodiments is made, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

Additionally, the purpose of the Abstract is to enable the patent office and the public generally, and especially the scientists, engineers and practitioners in the art who are not familiar with patent or legal terms or phraseology, to determine quickly from a cursory inspection the nature of the technical disclosure of the application. The Abstract is not intended to be limiting as to the scope of the present inventions in any way.

We claim:

1. A track circuit for a railroad track block, said track circuit comprising:

a first occupied track device connected to rails of the railroad track block at a first portion of the block; and a second occupied track device connected to the rails of the railroad track block at a second portion of the block, said first and second occupied track devices being configured to:

detect a presence of a train on the rails of the block using a DC function, and once the presence of the train is detected, determine an amount of unoccupied track behind the train using an AC function, wherein said first occupied track device is calibrated in accordance with an impedance of the second occupied track device, and said second occupied track device is calibrated in accordance with an impedance of the first occupied track device, and wherein said first and second occupied track devices are configured to determine one or more broken rails in the block, while the train is within the block, based on one or more impedance readings along the rails of the track.

2. The track circuit of claim 1, wherein the DC function comprises transmitting DC coded signals along the rails of the block and detecting the presence of the train within the block based on the DC coded return signals along the rails.

3. The track circuit of claim 1, wherein the AC function comprises transmitting low frequency AC signals along the rails of the block and determining the amount of unoccupied track behind the train based on impedance characteristics of AC return signals along the rails.

4. The track circuit of claim 3, wherein the AC function further comprises determining an amount of unoccupied track ahead of the train based on an impedance characteristic of AC return signals along the rails.

5. The track circuit of claim 1, wherein each occupied track device comprises:

a transmitter connected to the rails of the block, the transmitter being controllable to transmit DC coded signals along the rails of the block during the DC function and to transmit low frequency AC signals along the rails of the block during the AC function; and a receiver connected to the rails of the block, the receiver being controllable to receive DC coded signals along the rails of the block during the DC function and to receive low frequency AC signals along the rails of the block during the AC function.

6. The track circuit of claim 5, wherein each occupied track device further comprises a control unit connected to the respective transmitter and receiver, said control unit being adapted to detect the presence of the train within the block based on the DC coded return signals along the rails and to determine the amount of unoccupied track behind the train based on impedance characteristics of AC return signals along the rails.

7. The track circuit of claim 6, wherein each control unit is further adapted determine an amount of unoccupied track ahead of the train based on an impedance characteristic of AC return signals along the rails.

8. A method of monitoring a railroad track block, said track method comprising:

providing a first occupied track device at a first end of the block;

providing a second occupied track device at a second end of the block;

calibrating the first occupied track device in accordance with an impedance of the second occupied track device;

calibrating the second occupied track device in accordance with an impedance of the first occupied track device;

performing a DC function to detect a presence of a train on rails of the block; and once the presence of the train is detected, performing an AC function to determine an amount of unoccupied track behind the train; and detecting one or more broken rails in the block, while the train is in the block, based on one or more impedance readings along the rails of the track.

9. The method of claim 8, wherein performing the DC function comprises:

transmitting DC coded signals along the rails of the block; and detecting the presence of the train within the block based on the DC coded return signals along the rails.

10. The method of claim 8, wherein performing the AC function comprises:

transmitting low frequency AC signals along the rails of the block; and determining the amount of unoccupied track behind the train based on impedance characteristics of AC return signals along the rails.

11. The method of claim 10, wherein performing the AC function further comprises determining an amount of unoccupied track ahead of the train based on an impedance characteristic of AC return signals along the rails.

12. An occupied track device adapted to be connected to rails of a railroad track block, said occupied track device comprising:

a transmitter adapted to be connected to the rails of the block, the transmitter being controllable to transmit DC coded signals along the rails of the block during a DC function and to transmit low frequency AC signals along the rails of the block during an AC function;

a receiver adapted to be connected to the rails of the block, the receiver being controllable to receive DC coded signals along the rails of the block during the DC function and to receive low frequency AC signals along the rails of the block during the AC function; and a control unit connected to the transmitter and receiver, said control unit being adapted to detect the presence of the train within the block based on the DC coded return signals along the rails and to determine the amount of unoccupied track behind the train based on impedance characteristics of AC return signals along the rails, wherein the occupied track device provides an impedance, wherein the occupied track device is calibrated in accordance with an impedance of another occupied track device, and the other occupied track device is calibrated in accordance with the impedance of the occupied track device, and wherein said first and second occupied track devices are configured to determine one or more broken rails in the block, while a train is within the block, based on one or more impedance readings along the rails of the track.

13. The occupied track device of claim 12, wherein the AC function further comprises determining an amount of unoccupied track ahead of the train based on an impedance characteristic of AC return signals along the rails.

* * * * *